US005975603A

United States Patent [19]

Novak-Taurman et al.

[11] Patent Number: 5,975,603

[45] Date of Patent: Nov. 2, 1999

[54] FIRE HYDRANT LIFTING AND SETTING DEVICE

[75] Inventors: Sandra Novak-Taurman; Wayne Taurman, both of Centralia, Wash.

[73] Assignee: Taurman Distributing & Manufacturing, Inc., Centralia, Wash.

[21] Appl. No.: 08/971,771

[22] Filed: Nov. 17, 1997

[51] Int. Cl.[6] ..... B66C 1/62

[52] U.S. Cl. ..... 294/67.3; 294/81.5; 294/90

[58] Field of Search ..... 294/67.1, 67.3, 294/67.31, 67.4, 67.5, 68.27, 74, 90, 81.2–81.5, 81.51, 81.55, 81.56; 137/272, 296

[56] References Cited

U.S. PATENT DOCUMENTS

| | | | |
|---|---|---|---|
| 1,032,271 | 7/1912 | Bransfield | 294/68.27 |
| 1,473,013 | 11/1923 | Clark . | |
| 2,136,443 | 11/1938 | Kepler | 294/81.51 |
| 2,384,307 | 9/1945 | Husson et al. | 294/67.31 |
| 2,409,684 | 10/1946 | Jenkins . | |
| 2,721,757 | 10/1955 | Anderson | 294/81.2 |
| 2,860,002 | 11/1958 | Herbst | 294/81.5 X |
| 2,875,982 | 3/1959 | Unglesby | 294/90 X |
| 3,010,751 | 11/1961 | Day et al. | 294/81.2 |
| 3,020,078 | 2/1962 | Ray | 294/63 |
| 3,215,464 | 11/1965 | Overman | 294/90 |
| 3,314,711 | 4/1967 | Dietz et al. | 294/81.5 X |
| 3,343,861 | 9/1967 | Sinicki | 294/67.3 X |
| 3,549,190 | 12/1970 | Caldwell | 294/81.5 X |
| 4,392,679 | 7/1983 | Barnes et al. | 294/67.1 X |
| 4,706,939 | 11/1987 | Gagne | 254/332 |
| 4,736,765 | 4/1988 | Campbell | 137/296 |
| 4,951,989 | 8/1990 | Goodin | 294/90 |
| 5,033,501 | 7/1991 | Stehling | 137/296 |

FOREIGN PATENT DOCUMENTS

| | | | |
|---|---|---|---|
| 158541 | 1/1983 | Germany | 294/67.3 |
| 379510 | 4/1973 | U.S.S.R. | 294/81.5 |
| 1172862 | 8/1985 | U.S.S.R. | 294/67.3 |

*Primary Examiner*—Johnny D. Cherry
*Attorney, Agent, or Firm*—Seed and Berry LLP

[57] ABSTRACT

A fire hydrant lifting harness includes a lifting triangle, a pair of connecting cables, and a pair of rigid paddles. The lifting triangle includes two bracing members, one each at two corners, forming eyelets therein. For each eyelet, a cable passes through it and the cable is wound around itself. The other end of each cable is attached to a respective lifting paddle in a similar manner. The paddle is made from a rigid material and includes a bend, between the two ends, so that the paddle does not contact the head of the fire hydrant. The end of the paddle opposite from where the cable connects includes an aperture designed to accommodate one of the ports from the fire hydrant. For lifting, the port cap is removed, the paddle is placed around the port and against the hydrant, and the port cap replaced. A lifting force then raises the fire hydrant lifting device which in turn raises the fire hydrant.

14 Claims, 3 Drawing Sheets

FIRE HYDRANT LIFTING AND SETTING DEVICE

TECHNICAL FIELD

The present invention relates to a harness used for lifting an object which has multiple projections, and more particularly for lifting and placing a fire hydrant.

BACKGROUND OF THE INVENTION

Fire hydrants are heavy objects, and occasionally must be moved. They are moved during installation, which often coincides with road construction. They are also moved for maintenance of the hydrant, or for maintenance of the water supply line to which the hydrant connects. Because of their weight, hydrants cannot be easily lifted by the installers. Therefore, some lifting force, for example a backhoe or front loader, is used to lift them.

When lifting a hydrant with a backhoe, an installer usually wraps a chain around a head of the hydrant, and connects it to the lifting force. This method has a number of disadvantages. For instance, when wrapped around the head, the lifting part of the chain touches one side and is not centered above the fire hydrant. This causes the fire hydrant to be tilted from the vertical position during lifting, hindering installation. Additionally, the chain may slip over the head of the fire hydrant while being lifted, possibly causing damage to the fire hydrant.

Prior art tools and apparatus for setting fire hydrants are exemplified by U.S. Pat. No. 4,951,989 to Goodin and U.S. Pat. No. 4,706,939 to Gagne. The setting tool of Goodin includes a collar formed by flat steel plates which are placed underneath the head of the fire hydrant. The plates are secured by passing a pin through mounting guides on each plate. Goodin's collar assembly includes components which will become worn with use. Additionally, several assemblies are needed to accommodate differing hydrant sizes.

The setting tool of Gagne is used when separating the fire hydrant from an extension pipe connecting it to the water supply pipe. A mount is slipped around a flange of the extension pipe and secured with a clasping band. This type of tool cannot be used in the initial installation of the hydrant and extension pipe combination, because it uses the extension pipe for support. Further, a lifting chain directly contacts the head of the fire hydrant, possibly damaging it. Finally, coupling plates which slip over port cap studs on the hydrant are not secured, creating the possibility of the plates slipping off the studs when lifting the hydrant.

SUMMARY OF THE INVENTION

The inventive lifting apparatus is used for lifting objects having at least one projection extending therefrom. In an exemplary embodiment, one or more lifting arms temporarily attach to the object to be lifted. An aperture is provided through at least one of the lifting arms to receive one of the projections of the object. The lifting arm is secured to the object, so as not to become disengaged while lifting. The lifting arms are connected to a lifting device, and when the device lifts the arms, each arm transfers a portion of the lifting force from the lifting device to the projection of the object to be lifted, thereby lifting the object.

In one embodiment, two lifting arms may be held apart to obtain a lifting force which is evenly distributed to the object. The mechanism by which the arms are held apart can be any appropriate rigid surface, such as a lifting triangle. A further embodiment includes a coupling member such as a cable or chain used to connect the lifting arms to a bracket which holds the arms apart.

In a preferred embodiment, the lifting apparatus is used to lift a fire hydrant having protruding ports. The lifting apparatus includes an attachment member that is triangularly shaped and has eyelets in two corners. The corner without eyelets is attachable to the lifting device. One cable attaches at one end to each eyelet and at the other end to the lifting arm. At one end of the lifting arm, opposite from the attached cable, an aperture is sized to accept one of the protruding ports from the fire hydrant. Additionally, the lifting arms are bent such that when attached to the fire hydrant, the bend provides clearance around the head of the fire hydrant.

In operation, the lifting apparatus is attached to the fire hydrant as described above. The lifting device provides a lifting force to the apparatus, which is transferred to the hydrant. When the hydrant is being lifted from a horizontal position, such as laying on the ground or the bed of a truck, the lifting apparatus exerts a lifting force on the hydrant's ports and the hydrant rotates about the lower portion until it is lifted from its resting surface. The hydrant is positioned into place, secured, and the apparatus removed.

DETAILED DESCRIPTION OF THE INVENTION

Figure 1:
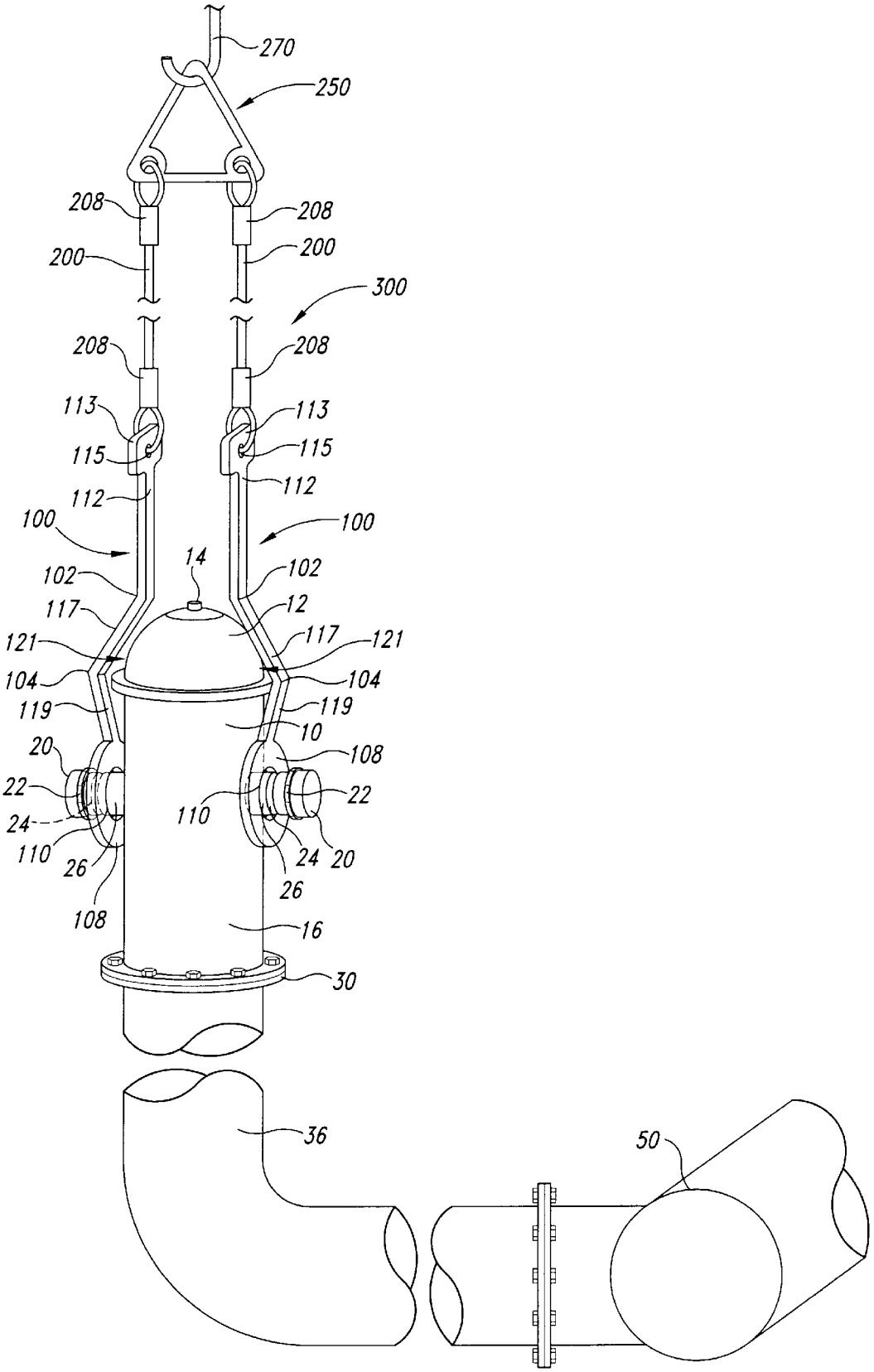
FIG. 1 is an isometric view of a lifting apparatus of the present invention shown with two lifting arms attached to a fire hydrant.

A fire hydrant 10 known in the prior art is shown in FIG. 1. The main components of the fire hydrant 10 include a body 16 having two ports 26 extending therefrom, and each port including external threads 24. Additionally, the topmost portion of the fire hydrant 10, generally called a head 12, is larger in circumference than the body 16. The ports 26 are each capped by a threaded port cap 20 which is held in place by tightening the threaded cap onto the port's external threads 24. A nut 22 secured to each port cap 20 allows the use of a wrench when removing or installing the port cap.

The fire hydrant 10 is secured to an extension pipe 36 at a flange 30. The extension pipe 36 is sized to extend from the bottom of the flange 30, typically installed near ground level, to a water supply pipe 50, which is usually located underground. Typical lengths of the extension pipe 36 are 3 to 5 feet and may include bends. When the fire hydrant 10 is delivered to an installation site, the extension pipe 36 is typically already attached to the flange 30 so the fire hydrant and extension pipe are connected to the water supply pipe 50 as a unit. The combination of the fire hydrant 10 and the extension pipe 36 can weigh several hundred pounds; thus there is a need to lift the hydrant with a lifting device so the fire hydrant is safely supported while installing or removing the fire hydrant from the water supply pipe 50.

A lifting harness 300 in accordance with an exemplary embodiment of the present invention is shown in FIG. 1 attached to the fire hydrant 10. The lifting harness 300 includes a pair of lifting paddles 100 removably attached at a lower end portion 108 to the fire hydrant's ports 26. An upper portion 112 of each lifting paddle 100 is connected to a lifting cable 200 or other suitable connection means, such as a chain or the like. The lifting cable 200, in turn, is attached to a lifting triangle 250 that is an attachment member removably connected to a hook 270 coupled to a backhoe (not shown) or other suitable lifting device. Accordingly, a lifting force from the lifting device is transmitted to the fire hydrant 10 by the lifting harness 300, so the fire hydrant and lifting harness are lifted as a unit.

Figure 2:
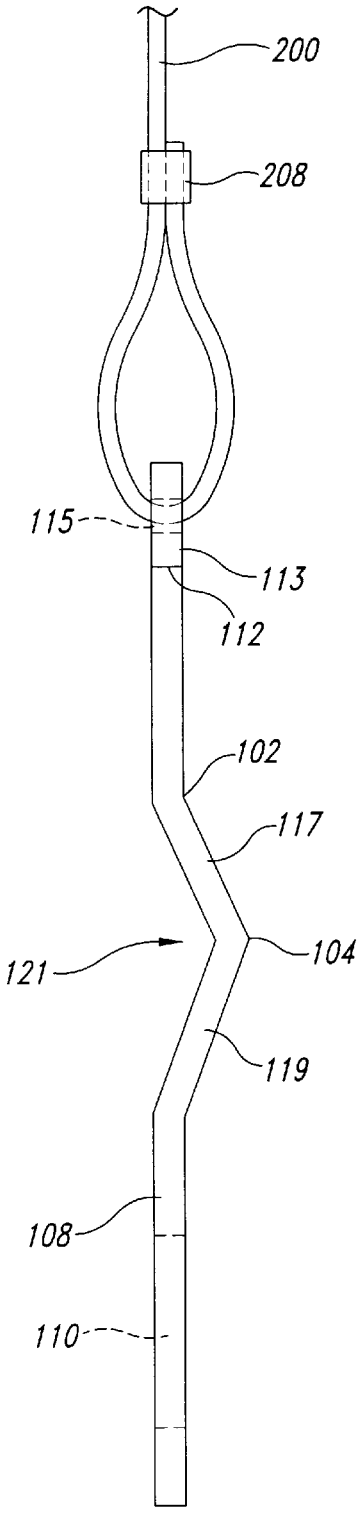
FIG. 2 is a partial left side view of one of the lifting arms of the lifting apparatus of FIG. 1.
Figure 3:
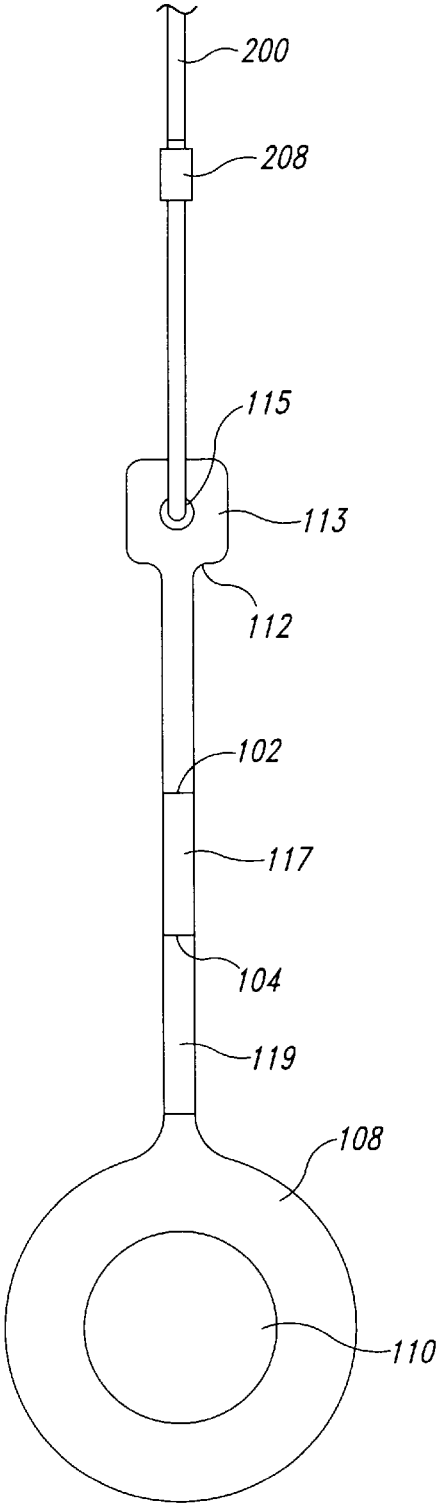
FIG. 3 is a partial front side view of the lifting arm of FIG. 1.

In the exemplary embodiment, the two lifting paddles 100 have the same configuration, so only one lifting paddle will be described herein and the description is applicable to both lifting paddles. As best seen in FIGS. 1, 2, and 3, the lifting paddle's lower end portion 108 is an enlarged disk-shaped portion that has an aperture 110 therein sized to removably receive the fire hydrant's port 26 therethrough when the lifting paddle 100 is attached lo the fire hydrant 10 for lifting.

The aperture 110 has a diameter that is larger than the diameter of the fire hydrant's port 26 so the lower end portion easily slips over the port when the port cap 20 is removed. The diameter of the aperture 110, however, is smaller than the diameter of the port cap 20. When the lifting paddle's lower end portion 108 is positioned over a port 26 and the port cap 20 is then screwed onto the port, the lower end portion is trapped between the port cap and the fire hydrant's body 16 so the lifting paddle 100 cannot inadvertently slip off of the port during a lifting procedure. In the exemplary embodiment, the paddles 100 can rotate about the ports 26 when trapped thereon.

The lifting paddle 100 also has a body region 102 that is connected to the lower end portion 108 and that extends away from the lower end portion. The body region 102 includes a contoured section 104 having a contoured shape defined by a pair of interconnected upper and lower body segments 117 and 119. The lower body segment 119 is integrally attached to the lower end portion 108 at a selected angle relative thereto, and the upper body segment 117 is integrally connected to the lower body segment and spaced apart from the lifting paddle's lower end portion. The upper and lower body segments 117 and 119 are interconnected at selected angles relative to each other and relative to the lower end portion 108 so as to define a hydrant-head-receiving area 121 (FIGS. 1 and 2). The hydrant-head-receiving area 121 is shaped and sized to receive the head 12 of the fire hydrant 10 (FIG. 1) when the lifting paddle 100 is attached to the fire hydrant. The contoured section 104 provides sufficient clearance between the paddle's body region 102 and the fire hydrant's head 12 so the lifting paddle does not engage the fire hydrant's head. In the exemplary embodiment, the lifting paddle 100 is made of steel or other suitable metal with a thickness of approximately ½ inch, so the paddle's body region 102 is sufficiently strong to lift the fire hydrant 10 and extension pipe 36 as a unit substantially without flexing or bending at the contoured section 104 under the weight of the fire hydrant and extension pipe.

The upper body segment 117 of the lifting paddle's body region 102 is integrally connected to the lifting paddle's upper portion 112. The upper portion 112 has an enlarged engagement portion 113 with an aperture 115 that is shaped and sized to receive the lifting cable 200 therethrough. The lifting cable 200 loops through the aperture 115 in the engagement portion 113 and connects to itself so as to form a conventional cable junction 208. Accordingly, the lifting paddle 100 is pivotally attached to the loop in the lifting cable 200.

Figure 4:
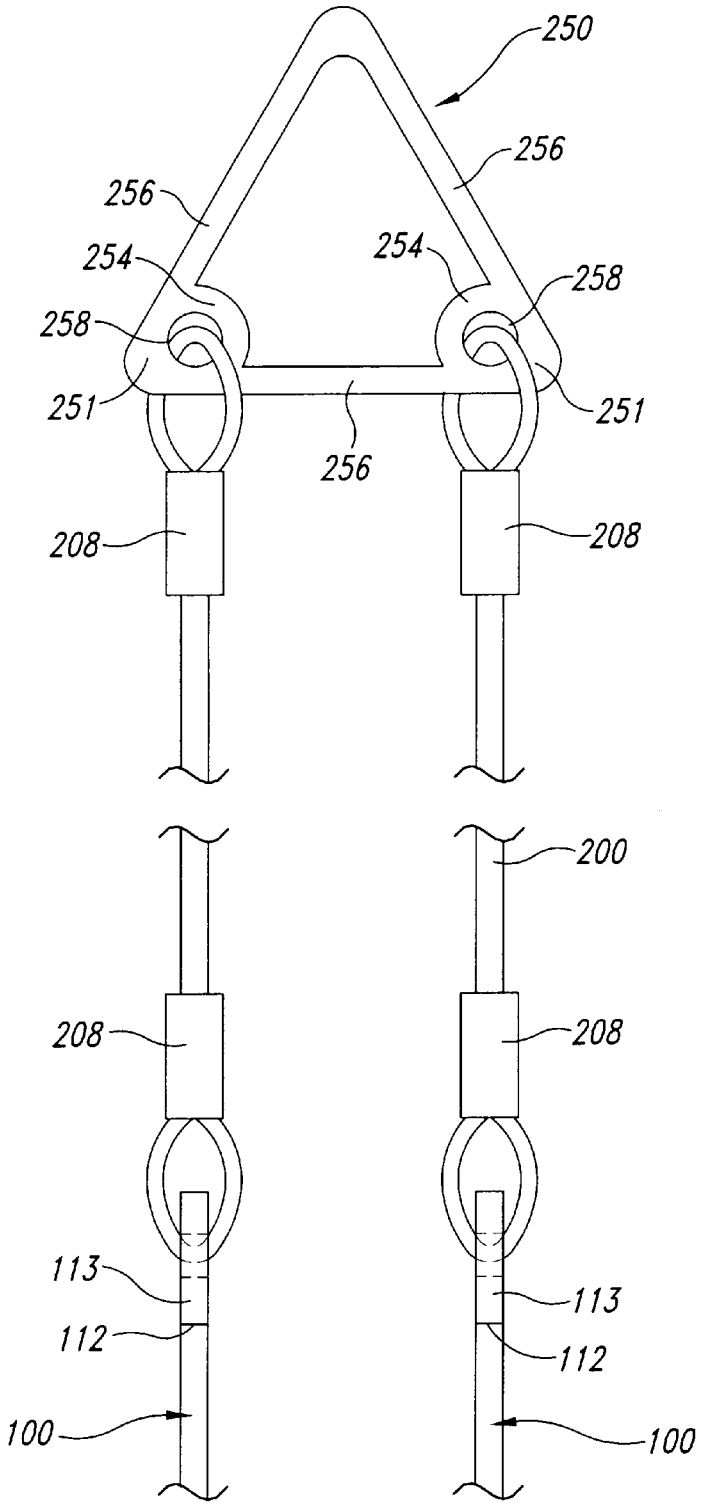
FIG. 4 is a partial side elevation view of the lifting paddle, lifting cable, and lifting triangle of the lifting apparatus of FIG. 1.

As best seen in FIGS. 1 and 4, the lifting cable 200 extends away from the lifting paddle 100 and connects to the lifting triangle 250. The lifting cable 200 is looped through corner portions of the lifting triangle 250 and connected to itself to form a conventional cable junction so the cable is securely yet pivotally fixed to the lifting, triangle. In the preferred embodiment, the lifting cable is a ½ inch cable having a length of approximately 27 inches, although the cable thickness and length can be varied depending upon the strength and size requirements for the lifting harness 300.

As best seen in FIG. 4, the lifting triangle 250 has three side segments 256 integrally connected to form an equilateral triangle. The lifting triangle 250 also has stability members 254 integrally connected to the side segments 256 at the lifting triangle's two lower corners 251, and the stability members each include or form an eyelet 258 therein. The eyelets 258 are shaped and sized to receive the upper portion of the lifting cable so the lifting cable loops through the respective eyelet and connects to itself at the cable junction 208 so as to securely interconnect the lifting triangle to the lifting cable. The stability members 254 hold the lifting cables in a spaced-apart relationship. Accordingly, the lifting triangle 250 prevents the lifting cables 200 from sliding toward each other along the lower segment 256 of the lifting triangle during a lifting procedure, which could create an imbalance of the lifting harness 300 and fire hydrant 10. The lifting triangle 250, thus, keeps the lifting cables 200 and lifting paddles 100 spaced apart with the fire hydrant position therebetween in an aligned and balanced position for easy and safe maneuverability of the fire hydrant 10 and extension pipe 36 (FIG. 1) during the lifting procedure.

The stability members 254 with eyelets 258 therein are also adapted to allow the upper ends of the lifting cable 200 to pivot relative to the respective eyelet so the lifting harness will not bind on itself during a lifting operation as the lifting triangle is lifted relative to the lifting paddles 100 to put the lifting harness into vertical tension or when the lifting triangle is lowered relative to the lifting paddles to release the vertical tension, such as during a process of removing the lifting paddles from the fire hydrant.

The lifting harness 300 shown in FIG. 1 removably connects to the fire hydrant's protruding ports 26 in the following manner. One of the port caps 20 is removed from its respective port 26. A wrench can be applied to the port nut 22 on the port cap if the port cap is more than hand-tight. The aperture 110 in the lifting paddle's lower end portion 108 is then slipped over the port 26, and the port cap 20 is replaced. It is preferable to replace the port cap far enough so that the paddle 100 does not slip off, but not so far as to prevent the paddle 100 from rotating around the port relative to the fire hydrant's body 16. By rotatably connecting the lifting paddles 100 to the ports 26 while being lifted, the fire hydrant 10 can rotate about a horizontal axis that is coaxially aligned with the ports 26. Accordingly, the fire hydrant 10 can rotate between a horizontal position and vertical position, while the lifting paddles 100 remain in a substantially vertical position.

In operation, as an example, the lifting harness 300 is connected to a fire hydrant 10 that has been transported to an installation site and is laying horizontally on the ground or the bed of a truck or the like. The lifting paddles 100 are attached to the fire hydrant's ports 26 as described above, and the lifting triangle 250 is attached to the backhoe (not shown) or other lifting device that generates a sufficiently large lifting force. The backhoe raises the lifting triangle 250, lifting cables 200 and lifting paddles 100 to remove slack in the lifting harness 300, so that the lifting harness is in a substantially vertical position while the fire hydrant 10 remains horizontal.

As the upward lifting force continues to be exerted on the lifting triangle 250, the lifting force is transmitted to the ports 26 through the lifting paddles 100, which causes the head 12 of the fire hydrant to raise off the ground while the bottom end of the extension pipe 36 stays on the ground, such that the fire hydrant pivots about the bottom end of the extension pipe. As discussed above, the ports 26 rotate within the aperture 110 in the lifting paddles 100 as the fire hydrant pivots to a vertical position. The lifting continues until the fire hydrant is in a substantially vertical position, with the bottom end of the extension pipe 36 still on or adjacent to the ground.

More lifting force is applied, which further lifts the vertically oriented fire hydrant 10 so the extension pipe is lifted a selected distance above the ground. The fire hydrant 10 and extension pipe 36 can then be moved with the lifting harness 300 as a unit to a location above the area to which the extension pipe is to be clamped, for example, to the water supply pipe 50. The fire hydrant 10 and extension pipe 36 are lowered with the lifting harness 300 to a selected position and secured into place, such as bolted to the water supply pipe 50. Once the fire hydrant 10 is installed and secured in its selected position, vertical tension is released from the lifting harness 300, and the lifting harness is detached from the fire hydrant by unscrewing the port caps 20 and removing the lifting paddles 100 from the ports 26. The port caps 20 are then replaced.

The lifting harness 300 is also usable to remove a fire hydrant 10 from a water supply pipe 50 by attaching the lifting harness to the fire hydrant as discussed above, and putting the lifting harness in vertical tension. The fire hydrant 10 and extension pipe 36 are then disconnected from the water supply pipe in a conventional manner, while the lifting harness 300 holds the fire hydrant and extension pipe in a substantially vertical position. The lifting harness 300, the fire hydrant 10, and extension pipe are then lifted as a unit away from the water supply pipe 50 and moved to a selected position over the ground or other receiving area. The fire hydrant 10 and extension pipe 36 are then lowered so as to engage the ground and pivot relative to the lifting paddles 100 from the vertical position to the horizontal position. Vertical tension is then released from the lifting harness 300, and the lifting paddles 100 removed from the fire hydrant's ports. While the installation and removal processes are described herein with the fire hydrant 10 being connected to the extension pipe 36, the fire hydrant and extension pipe need not be connected together for the fire hydrant installation or removal processes using the lifting harness 300 of the present invention.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method of lifting a fire hydrant using a lifting harness connectable to a lifting device, the method comprising the steps of:

attaching a first lifting paddle having a collar portion with an aperture to a first port of the fire hydrant;

attaching a second lifting paddle having a collar portion with an aperture to a second port of the fire hydrant;

coupling the first and second lifting paddles to the lifting device;

applying a lifting force from the lifting device to the first and second lifting paddles after the first and second lifting paddles are attached to the respective first and second ports; and lifting the fire hydrant and the first and second lifting paddles as a unit to a selected position;

wherein the steps of attaching the first and second lifting paddles to the ports include the steps of removing a port cap from each of the first and second ports of the hydrant, placing the first and second lifting paddles over the respective first and second ports, and replacing the port caps on the respective first and second ports after the paddles are in place so that each port cap retains the respective first and second lifting paddle on the respective first and second port, and the step of placing the first and second lifting paddles over the respective first and second ports further includes the steps of positioning the collar portions of each paddle around a respective port, with the respective port extending through the aperture, and moving the collar portions of the paddles into engagement with the ports.

2. The method of claim 1 wherein the fire hydrant is resting in a non-vertical orientation on a selected surface with each port of the hydrant being exposed and the method further includes the step of pivoting the fire hydrant from the non-vertical position to a substantially vertical position.

3. The method of claim 2 wherein the step of pivoting the fire hydrant includes rotating the ports relative to the first and second lifting paddles.

4. The method of claim 1, further including the steps of:

moving the hydrant after the hydrant is lifted and in the substantially vertical position to a selected position directly above a desired location; and lowering the hydrant from the selected position to an installation position where the fire hydrant can be attached to a water supply pipe.

5. A method of lifting a fire hydrant using a lifting harness connectable to a lifting device, the method comprising the steps of:

removing a port cap from each of a first and a second port of the hydrant;

placing first and second lifting paddles over the respective first and second ports;

replacing the port caps on the respective first and second ports after the paddles are in place so that each port cap retains the respective first and second lifting paddle on the respective first and second port;

coupling the first and second lifting paddles to the lifting device;

applying a lifting force from the lifting device to the first and second lifting paddles after the first and second lifting paddles are attached to the respective first and second ports; and lifting the fire hydrant and the first and second lifting paddles as a unit to a selected position.

6. A method of lifting a fire hydrant using a lifting harness connectable to a lifting device, the method comprising the steps of:

attaching a first lifting paddle to a first port of the fire hydrant;

attaching a second lifting paddle to a second port of the fire hydrant;

coupling the first and second lifting paddles to the lifting device;

applying a lifting force from the lifting device to the first and second lifting paddles after the first and second lifting paddles are attached to the respective first and second ports; and lifting the fire hydrant and the first and second lifting paddles as a unit to a selected position;

wherein the steps of attaching the first and second lifting paddles to the ports include the steps of removing a port cap from each of the first and second ports of the hydrant, placing the first and second lifting paddles over the respective first and second ports, and replacing the port caps on the respective first and second ports after the paddles are in place so that each port cap retains the respective first and second lifting paddle on the respective first and second port and each port cap is in direct physical contact with a respective one of the lifting paddles.

7. A method of lifting a fire hydrant using a lifting harness connectable to a lifting device, the method comprising:

attaching a first lifting paddle to a first port of the fire hydrant;

placing a first port cap on the first port of the fire hydrant to retain the first lifting paddle on the first port;

attaching a second lifting paddle to a second port of the fire hydrant;

placing a second port cap on the second port of the fire hydrant to retain the second lifting paddle on the second port;

coupling the first and second lifting paddles to the lifting device; and lifting the fire hydrant and the first and second lifting paddles as a unit to a selected position.

8. The method of claim 7 wherein the fire hydrant is resting in a non-vertical orientation on a selected surface with each port of the hydrant being exposed and the method further includes pivoting the fire hydrant from the non-vertical position to a substantially vertical position.

9. The method of claim 8 wherein pivoting the fire hydrant includes rotating the ports relative to the first and second lifting paddles.

10. The method of claim 7 wherein the fire hydrant is coupled to an extension pipe.

11. A method of lifting a fire hydrant using a lifting harness connectable to a lifting device, comprising the steps of:

placing first and second lifting paddles over respective first and second ports of the fire hydrant;

placing first and second port caps on the respective first and second ports after the paddles are in place so that the first and second port caps respectively retain the first and second lifting paddles on the respective first and second port;

coupling the first and second lifting paddles to the lifting device; and lifting the fire hydrant and the first and second lifting paddles as a unit to a selected position.

12. The method of claim 11 wherein the fire hydrant is resting in a nonvertical orientation on a selected surface with each port of the hydrant being exposed and the method further includes pivoting the fire hydrant from the non-vertical position to a substantially vertical position.

13. The method of claim 11, further including:

after the hydrant is lifted and in the substantially vertical position, moving the fire hydrant to a selected position above a desired location; and lowering the hydrant from the selected position to an installation position where the fire hydrant is attachable to a water supply.

14. The method of claim 11 wherein the fire hydrant is coupled to an extension pipe.

* * * * *